US012372255B2

(12) United States Patent
Pandelidis

(10) Patent No.: US 12,372,255 B2
(45) Date of Patent: Jul. 29, 2025

(54) EVAPORATIVE HEAT EXCHANGER

(71) Applicant: Baryon Inc., Wilmington, DE (US)

(72) Inventor: Demis Lukasz Pandelidis, Wroclaw (PL)

(73) Assignee: BARYON INC., Wilmington, DE (US)

( * ) Notice: Subject to any disclaimer, the term of this patent is extended or adjusted under 35 U.S.C. 154(b) by 220 days.

(21) Appl. No.: 18/345,702

(22) Filed: Jun. 30, 2023

(65) Prior Publication Data

US 2025/0003610 A1 Jan. 2, 2025

(51) Int. Cl.

| | |
|---|---|
| ***F24F 6/04*** | (2006.01) |
| ***F24F 13/30*** | (2006.01) |
| *F24F 6/00* | (2006.01) |
| *F28F 9/013* | (2006.01) |

(52) U.S. Cl.

CPC ..... *F24F 6/04* (2013.01); *F24F 13/30* (2013.01); *F24F 2006/008* (2013.01); *F28F 9/0131* (2013.01)

(58) Field of Classification Search

CPC ..... F28C 2001/145; F28F 9/0131; F24F 6/04; F24F 2006/008; F24F 13/30

See application file for complete search history.

(56) References Cited

U.S. PATENT DOCUMENTS 5,056,590 A * 10/1991 Bohn ..... F28F 3/083 165/166
5,453,223 A 9/1995 Maisotsenko
2002/0073718 A1 6/2002 Maisotsenko et al.
2003/0033821 A1 2/2003 Maisotsenko et al.
2005/0016197 A1 1/2005 Bourne et al.
2007/0101746 A1 5/2007 Schlom et al.
2009/0178426 A1* 7/2009 Bhatti ..... F25B 39/04 62/304
2011/0126564 A1 6/2011 Anandhakrishnan
2020/0395621 A1* 12/2020 Han ..... H01M 8/0258

FOREIGN PATENT DOCUMENTS

FI 126223 B 8/2016

OTHER PUBLICATIONS

International Search Report and Written Opinion dated Nov. 6, 2023 for PCT/US2023/069517.

* cited by examiner

*Primary Examiner* — Lionel Nouketcha
(74) *Attorney, Agent, or Firm* — King & Spalding LLP

(57) ABSTRACT

An evaporative heat exchanger includes a plurality of parallel plates forming a plurality of channels for a primary air flow and a secondary air flow. The secondary air flow evaporates a liquid thereby cooling the primary air flow. The plurality of parallel plates are assembled efficiently on a plurality of rods that pass perpendicularly through the plurality of plates. The rods have fasteners on each end with at least one of the fasteners being adjustable to facilitate assembly and securing of the plates. At least one gasket is located in each of the plurality of channels to provide sealing along portions of the edges of the parallel plates and to maintain spacing between the parallel plates.

20 Claims, 8 Drawing Sheets

EVAPORATIVE HEAT EXCHANGER

STATEMENT REGARDING FEDERAL GOVERNMENT RIGHTS

This invention was made with support from the U.S. government under contract number DE-EE0009683 awarded by the United States Department of Energy. The U.S. government has certain rights in this invention.

TECHNICAL FIELD

Embodiments of the technology relate generally to an evaporative heat exchanger comprising parallel plates that are secured together with rods.

BACKGROUND

Evaporative heat exchangers can be used in air conditioning systems to provide cool air through the evaporation of water. The large amount of heat absorbed in the evaporation of water allows an evaporative heat exchanger to provide cool air while using significantly less energy than an air condition system that relies upon vapor compression of a refrigeration cycle. Evaporative heat exchangers are particularly well-suited to climates with relatively low humidity.

Given the energy efficiency advantages evaporative heat exchangers provide, improvements associated with evaporative heat exchangers are desirable. In particular, improvements in the manufacturing and assembly of evaporative heat exchangers allowing them to be more widely used would be beneficial.

SUMMARY

The present disclosure relates to an evaporative heat exchanger. The evaporative heat exchanger can comprise: (i) a plurality of parallel plates with a plurality of channels disposed between the plates; and (ii) a plurality of rods joining the plurality of plates. The plurality of channels can comprise a primary air flow channels and secondary air flow channels, wherein the secondary air flow channels are arranged to receive a liquid. Each plate can have a plurality of plate apertures along the edges of the plate. The plurality of rods can pass perpendicularly through the plate apertures. At least one gasket can be placed in each channel between each pair of plates and along the edge of the plate. Each gasket can include at least one gasket aperture and a rod of the plurality of rods can pass through each gasket aperture. The plates and the gaskets can be placed on the rods in an alternating fashion to form the plurality of channels between the plates. After the plates and gaskets are placed on the rods, a fastener can be attached at the end of each rod to secure the plates and gaskets together to form the evaporative heat exchanger.

Another example embodiment provides a method for assembling an evaporative heat exchanger. The method can comprise: (i) sliding a first end plate and at least one gasket onto a plurality of rods. The first end plate can have a plurality of plate apertures through which the rods slide. Similarly, the at least one gasket can have at least one gasket aperture through which the at least one of the rods slide. The method further comprises sliding a plurality of intermediate plates, each separated by at least one intermediate gasket, onto the rods. The intermediate plates can have a plurality of plate apertures through which the rods slide. Similarly, the at least one gasket between each intermediate plate can have at least one gasket aperture through which the at least one of the rods slide. The method further comprises sliding a second plate onto the rods and onto an intermediate gasket. The second plate can have a plurality of plate apertures through which the rods slide. Next, the method comprises securing a fastener onto the ends of the rods to secure the plates and gaskets together.

The foregoing embodiments are non-limiting examples and other aspects and embodiments will be described herein. The foregoing summary is provided to introduce various concepts in a simplified form that are further described below in the detailed description. This summary is not intended to identify required or essential features of the claimed subject matter nor is the summary intended to limit the scope of the claimed subject matter.

BRIEF DESCRIPTION OF THE DRAWINGS

The accompanying drawings illustrate only example embodiments of apparatus and methods for an evaporative heat exchanger and therefore are not to be considered limiting of the scope of this disclosure. The principles illustrated in the example embodiments of the drawings can be applied to alternate methods and apparatus. Additionally, the elements and features shown in the drawings are not necessarily to scale, emphasis instead being placed upon clearly illustrating the principles of the example embodiments. Certain dimensions or positions may be exaggerated to help visually convey such principles. In the drawings, the same reference numerals used in different embodiments designate like or corresponding, but not necessarily identical, elements.

DETAILED DESCRIPTION OF EXAMPLE EMBODIMENTS

The example embodiments discussed herein are directed to apparatus and methods for an evaporative heat exchanger. The example embodiments described herein provide improved approaches to manufacturing and assembling evaporative heat exchangers. As will be described further below, the example evaporative heat exchangers use a plurality of rods which pass through the plates of the heat exchanger. The rods can have fasteners on each end which allow for easy assembly and securing of the plates on the rods. One or more gaskets are positioned in the channel between each plate for sealing and maintaining spacing between the plates. The combination of the rods and gaskets allows the evaporative heat exchanger to be assembled more easily and efficiently than past assembly approaches. Additionally, the combination of the rods and gaskets provides effective sealing of the exchanger plates while eliminating the need for screws or other fasteners attached to or between the plates which can contribute to undesirable leaks in the evaporative heat exchanger. The example evaporative heat exchangers described herein can be used to provide more economical and efficient air conditioning systems. The advantages of the evaporative heat exchangers described herein will be illustrated in greater detail in connection with the example embodiments described below.

In the following paragraphs, particular embodiments will be described in further detail by way of example with reference to the drawings. In the description, well-known components, methods, and/or processing techniques are omitted or briefly described. Furthermore, reference to various feature(s) of the embodiments is not to suggest that all embodiments must include the referenced feature(s).

Figure 1:
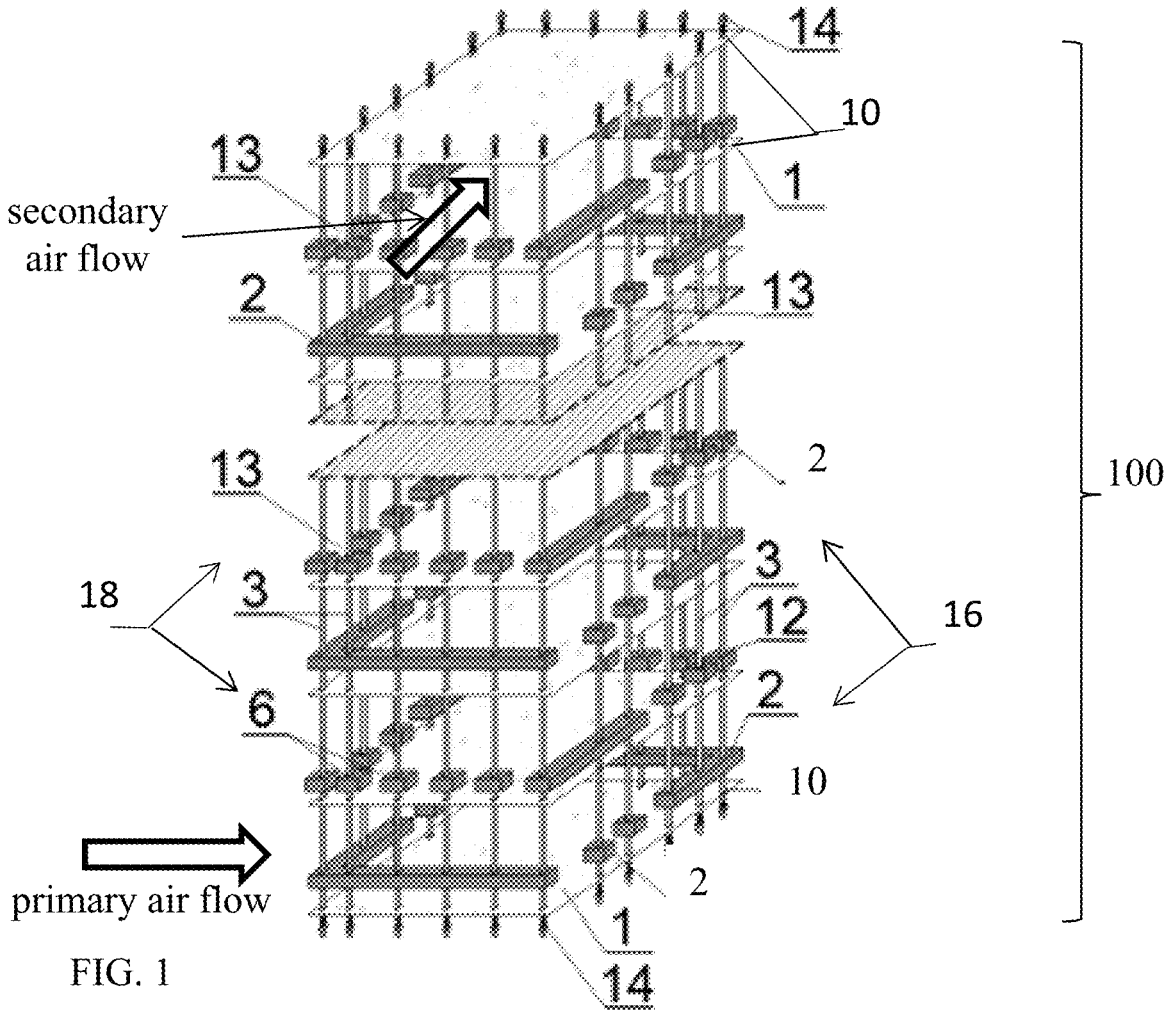
FIG. 1 illustrates an evaporative heat exchanger formed with fastening rods in accordance with an example embodiment of the disclosure.

Referring now to FIG. 1, an example evaporative heat exchanger 100 is illustrated. The evaporative heat exchanger 100 comprises a series of parallel plates 1, each of which has opposing broad sides bounded by edges. Each plate 1 has a plurality of plate apertures 10 located along the perimeter of each plate adjacent to the edges. The plates 1 are joined by a plurality of rods 3 passing perpendicularly through the plate apertures 10. In other words, each rod 3 has a longitudinal axis along its major length and the planes defined by the broad sides of the plates 1 are perpendicular to the longitudinal axis of each rod 3. Each rod 3 has a fastener 14 located at each end of the fastener. The fasteners 14 can be removable with any of a variety of attaching mechanisms, including threads, pins, screws, and detents. In certain examples, the fastener 14 at one end of each rod 3 is fixed (i.e., not removeable) and can be in the form of a welded or fastened cap, stopper, pin, or other fixed feature. As will be described further below, the evaporative heat exchanger 100 is assembled by sliding the plates 1 onto the rods 3 and then squeezing the plates together by attaching the fasteners 14. The fasteners 14 are larger than the diameter of the plate apertures 10 thereby preventing the plates 1 from sliding off of the rods 3. In certain examples, the first plate and the last plate placed onto the rods can be referred to as the first end plate and the second end plate, while the other plates between the first and second end plates can be referred to as the intermediate plates.

As further illustrated in FIG. 1, at least one gasket 2 is located between each plate 1. In the example of FIG. 1, multiple gaskets 2 are located between each plate 1. The gaskets 2 serve multiple purposes. First, the gaskets 2 maintain spacing between the parallel plates 1. The gaskets 2 also form a seal along portions of the edges of the plates 1, while leaving open passages along other portions of the edges of the plates 1. The gasket(s) 2 can have a variety of configurations. In the example of FIG. 1, multiple gaskets 2 are placed between each pair of plates with some gaskets having a longer length than other gaskets. In other embodiments, a single gasket can be used between each plate. For example, a single gasket could traverse the entire perimeter edge of the plate, but have openings along its length for the passages that permit the flow of air and water between the plates 1. The placement, sizes, and shapes of the gaskets and/or gasket openings can be selected to adjust the flow of air and water between the plates 1 of the evaporative heat exchanger 100.

The gaskets 2 also have one or more gasket apertures 12. The gasket apertures are oriented with a central axis of the gasket aperture being coaxial with the longitudinal axis of one of the rods 3 so that a rod 3 passes through each gasket aperture 12 as the gasket slides onto the rods. When assembling the evaporative heat exchanger, the plates 1 and the gaskets 2 can slide onto the rods in an alternating manner so that one or more gaskets are located between each plate 1 as illustrated in FIG. 1. This approach to configuring the plates and gaskets allows the evaporative heat exchanger to be assembled easily and efficiently. Additionally, the arrangement of the one or more gasket apertures 12 with a rod 3 passing through each gasket aperture assists in maintaining the desired seal between each gasket and plate. The arrangement of the one or more gasket apertures 12 with a rod 3 passing through each gasket aperture also eliminates the need for screws or other fasteners attached to the plates and gaskets, thereby minimizing the likelihood of undesirable leaking of air or water between the plates at the locations of the gaskets.

Figure 13:
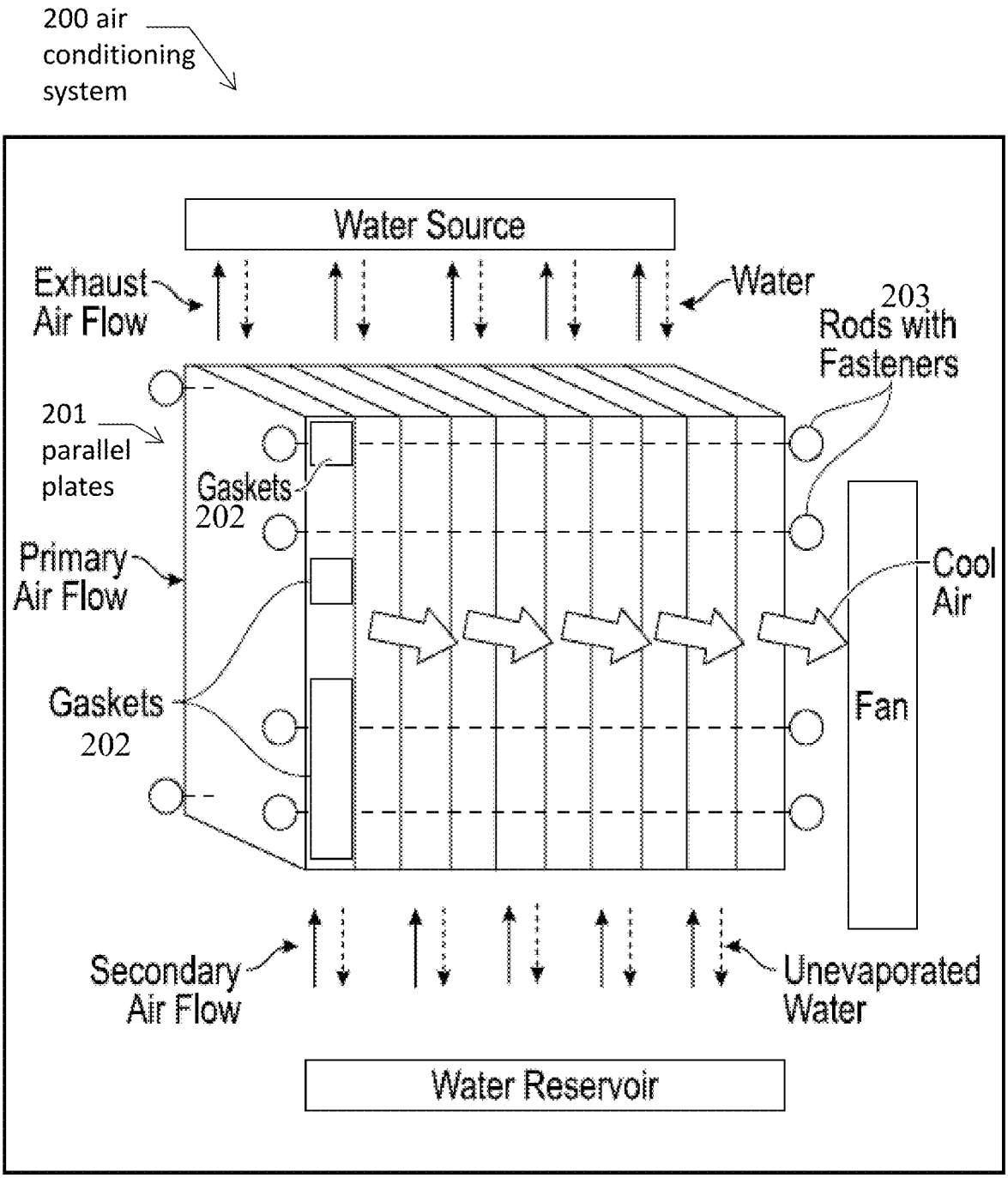
FIG. 13 illustrates an air conditioning system comprising an evaporative heat exchanger in accordance with an example embodiment of the disclosure.

Once the plates 1 and gaskets 2 are assembled on the rods 3 and the fasteners 14 are secured at the ends of the rods, the regions between each plate provide channels for the flow of air and water. Specifically, certain channels can be used as primary air flow channels 16 and certain other channels can be used as secondary air flow channels 18. As illustrated in the example of FIG. 1, typically the primary air flow channels 16 and the secondary air flow channels 18 are arranged in alternating manner to optimize the exchange of heat from primary air flow to the secondary air flow. However, in other embodiments, alternate arrangements of the primary air flow channels 16 and the secondary air flow channels 18 are possible. As further illustrated in the example of FIG. 1, the openings between the gaskets 2 provide air passages 13 for the primary air flow channels 16 and air and water passages 6 for the secondary air flow channels. As illustrated by the primary air flow and the secondary flow in FIG. 1, these flows are generally perpendicular to the longitudinal axis of the rods 3. Moreover, while not required, the primary air flow passes through the evaporative heat exchanger 100 at an orientation that is generally perpendicular to the flow of the water and the second air flow through the secondary air flow channels 18. The perpendicular orientation of these flows also is illustrated in FIG. 13.

To optimize the transfer of heat from the primary air flow channels 16 to the secondary air flow channels 18, the plates 1 are made of a thermally conductive material, such as any of various metallic materials, alloys, or composites. The gaskets 2 are typically made of materials that provide an effective seal against the air and water flowing between plates 1 and materials that are typically thermally insulative. Examples of materials from which the gaskets 2 can be made include rubber, cork, and various thermoplastic elastomers.

Figure 2:
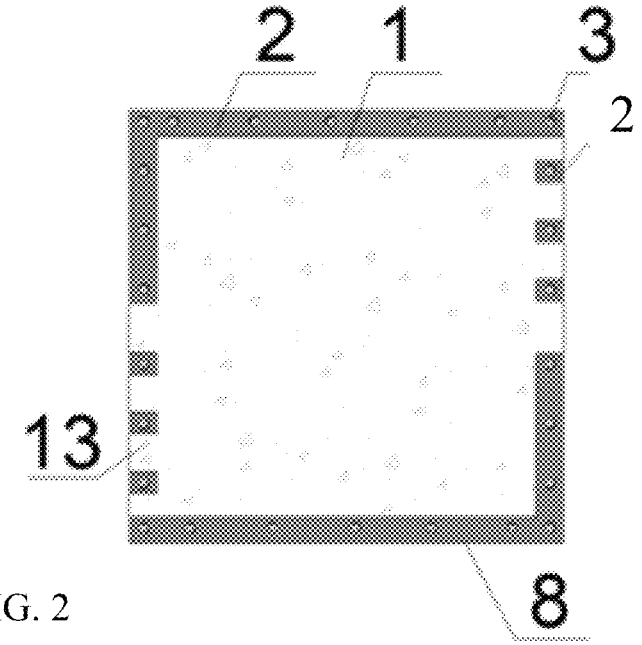
FIG. 2 illustrates a dry side of a rectangular plate for an evaporative heat exchanger in accordance with an example embodiment of the disclosure.
Figure 3:
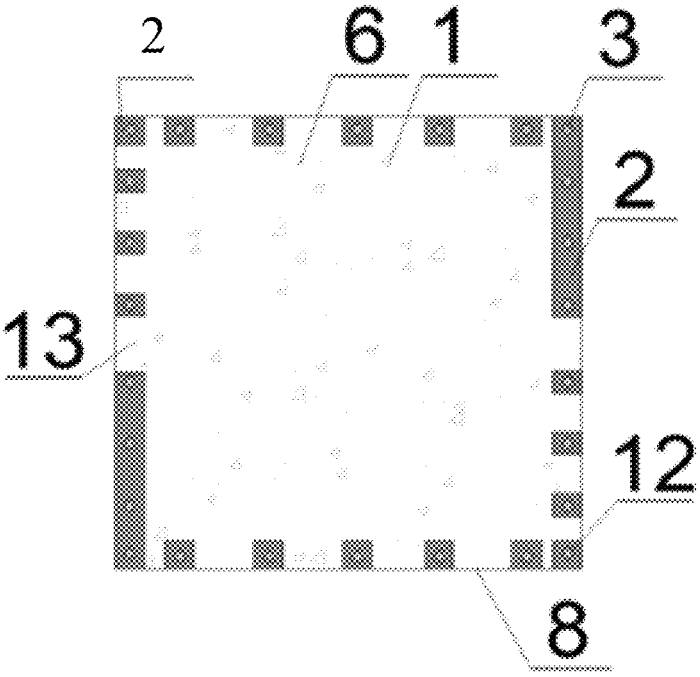
FIG. 3 illustrates a wet side of a rectangular plate for an evaporative heat exchanger in accordance with an example embodiment of the disclosure.

FIGS. 2-11 illustrate features of example components of an evaporative heat exchanger in accordance with the example embodiments herein. Features that are the same or similar to the features in the example of FIG. 1 use the same references numbers. Referring now to FIGS. 2 and 3, opposite broad sides of an example plate 1 are illustrated. FIG. 2 shows the dry side of plate 1, which is the side facing a primary air flow channel 16, and FIG. 3 shows a wet side of plate 1, which is the side facing a secondary air flow channel 18. The example plate 1 of FIGS. 1 and 2 illustrates the gaskets 2 positioned along the edges of the plate on both of the broad sides. Ends of rods 3 can be seen in the gasket apertures 12 in each gasket 2 thereby holding the gaskets 2 in place. On the dry side illustrated in FIG. 2, air passages 13 in the openings between the gaskets 2 allow the primary air flow along the dry side of the plate 1. On the wet side illustrated in FIG. 3, air and water passages 6 in the openings between the gaskets 2 allow the secondary air flow and the liquid that is evaporated to flow along the wet side of plate 1. While not required, as illustrated in FIGS. 2 and 3, the volume of space provided by the air and water passages 6 can be greater than the volume of space provided by the air passages 13 to optimize heat transfer.

Figure 4:
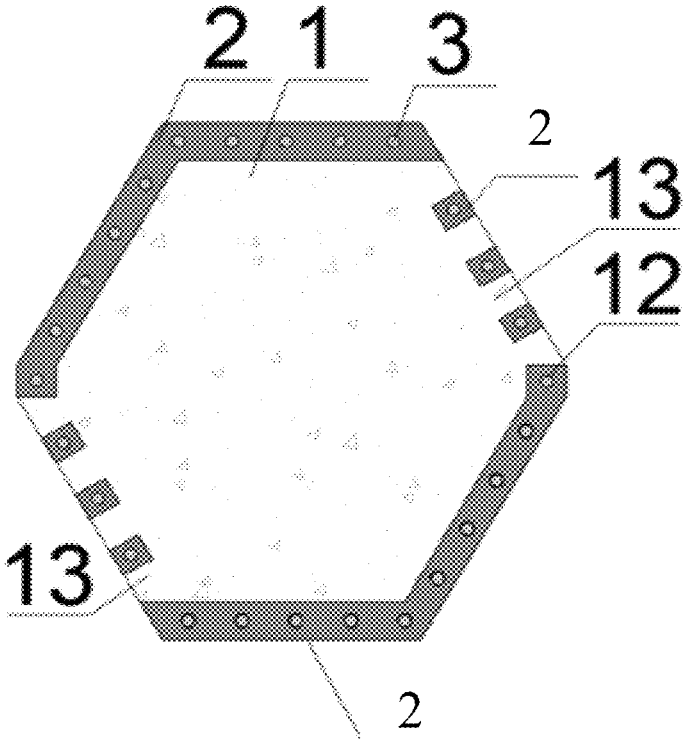
FIG. 4 illustrates a dry side of a hexagonal plate for an evaporative heat exchanger in accordance with an example embodiment of the disclosure.
Figure 5:
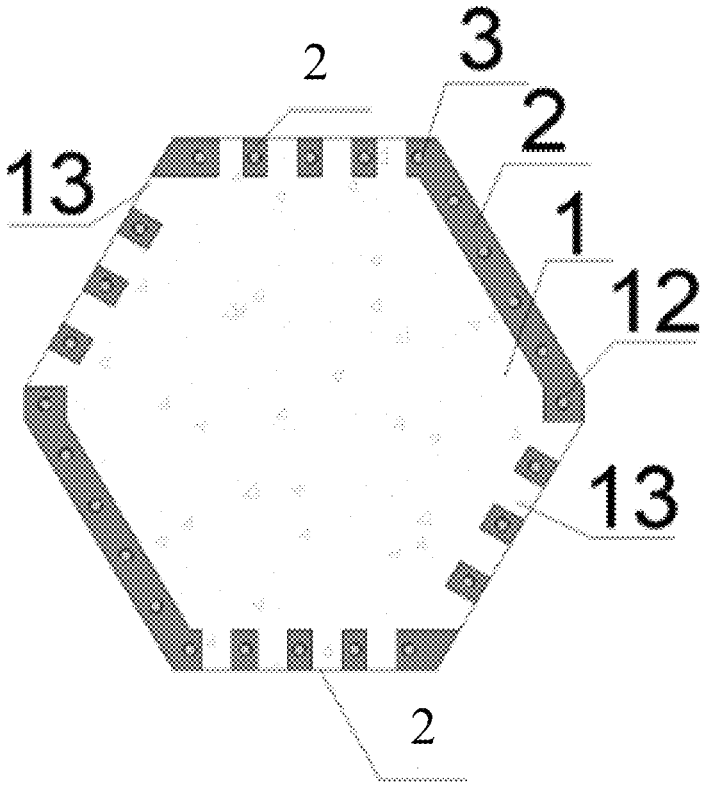
FIG. 5 illustrates a wet side of a hexagonal plate for an evaporative heat exchanger in accordance with an example embodiment of the disclosure.

FIGS. 4 and 5, illustrate the dry side and wet side, respectively, of another example of a plate 1. Plate 1 of FIGS. 4 and 5 is similar to plate 1 of FIGS. 2 and 3, except that the plate is hexagonal in shape. Otherwise, the description of the numbered features of FIGS. 1, 2, and 3 applies to the same numbered features in FIGS. 4 and 5. The square and hexagonal shapes of the plates are illustrative examples and in other embodiments the plates of the evaporative heat exchanger can have other shapes.

Figure 6:
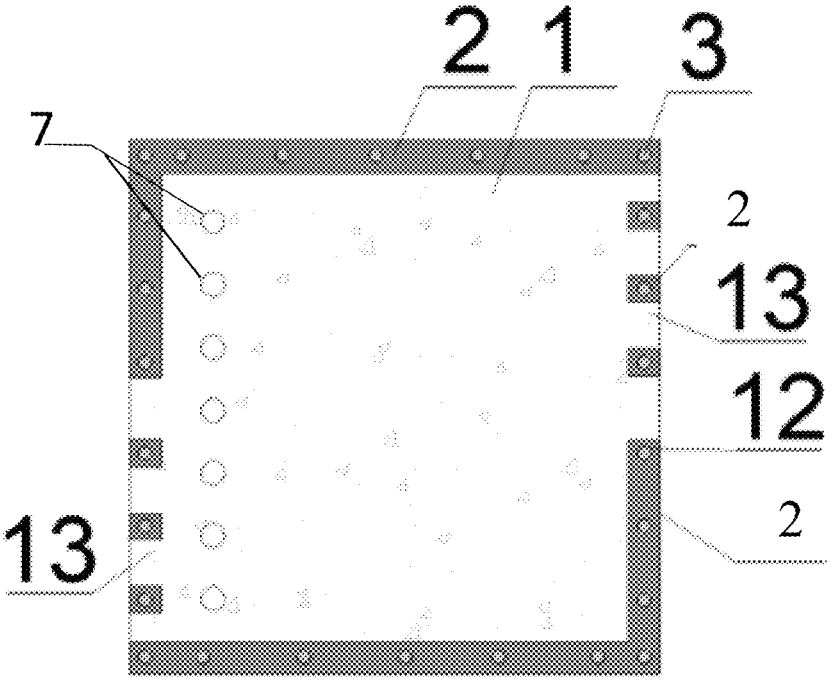
FIG. 6 illustrates a dry side of a rectangular plate with perforations for a regenerative evaporative heat exchanger in accordance with an example embodiment of the disclosure.
Figure 7:
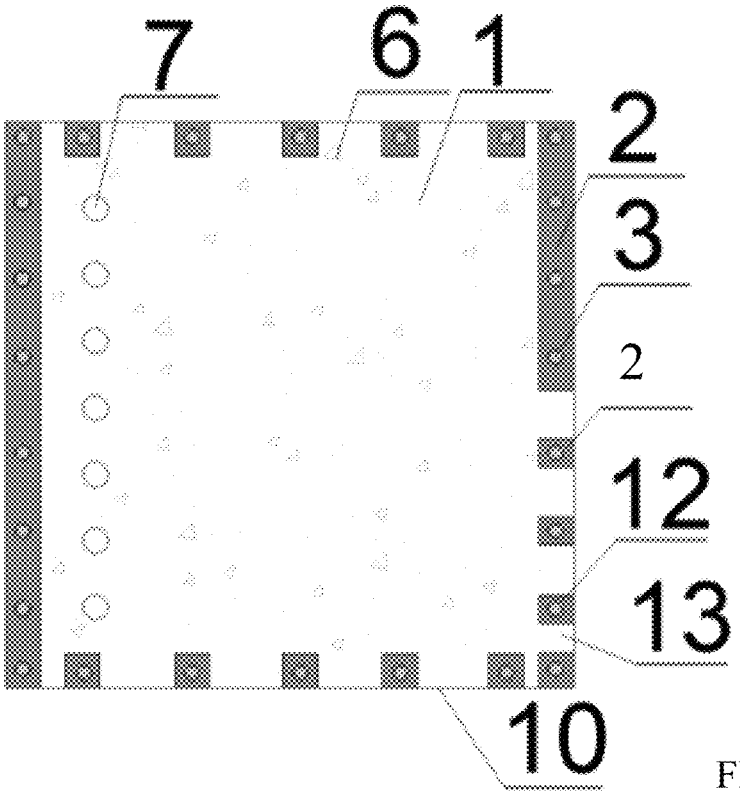
FIG. 7 illustrates a wet side of a rectangular plate with perforations for a regenerative evaporative heat exchanger in accordance with an example embodiment of the disclosure.

Referring to FIGS. 6 and 7, the dry and wet sides, respectively, of another example of a plate 1 are illustrated. Plate 1 of FIGS. 6 and 7 is similar to plate 1 of FIGS. 2 and 3, except that the plate includes a plurality of perforations 7 passing through the plate. The perforations allow air to flow between the primary air flow on the dry side of the plate and the secondary air flow on the wet side of the plate. Such a flow scheme is known as a regenerative flow. Otherwise, the description of the numbered features of FIGS. 1, 2, and 3 applies to the same numbered features in FIGS. 6 and 7.

Figure 8:
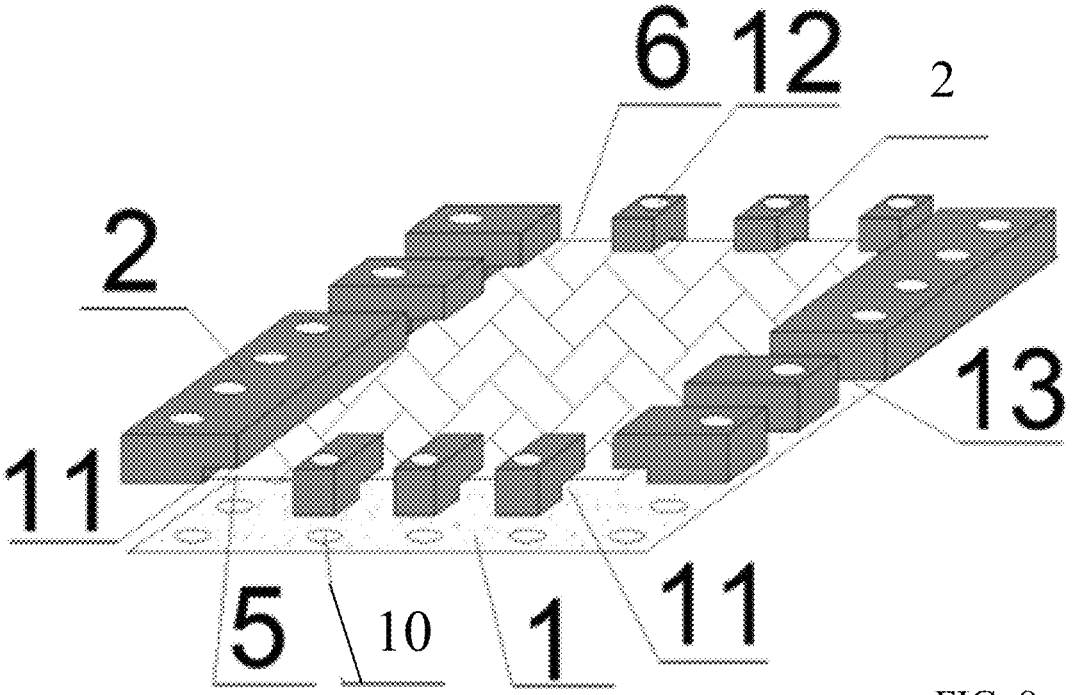
FIG. 8 illustrates a wet side of a rectangular plate with porous material for an evaporative heat exchanger in accordance with an example embodiment of the disclosure.
Figure 9:
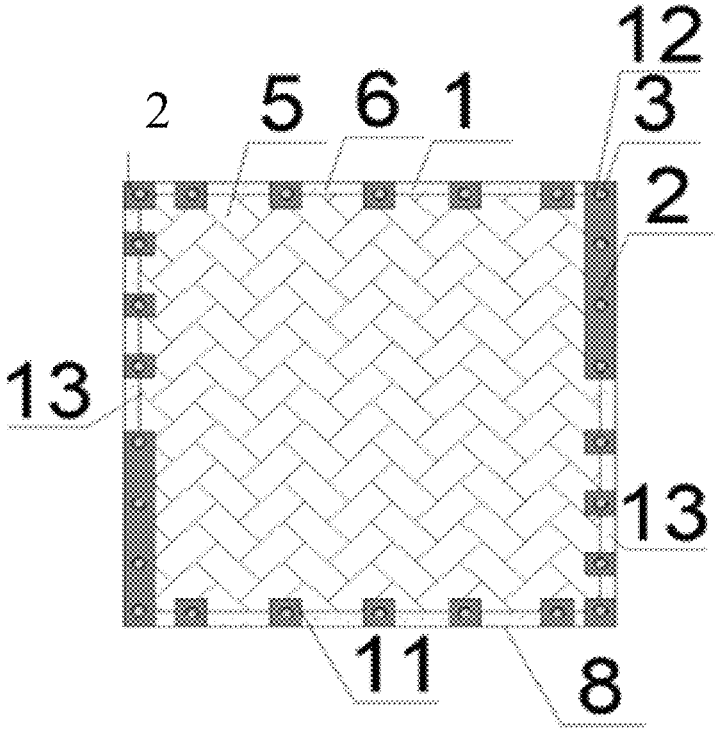
FIG. 9 illustrates a wet side of a rectangular plate with porous material for an evaporative heat exchanger in accordance with an example embodiment of the disclosure.

FIG. 8 illustrates another variation of the plate 1 of FIGS. 2 and 3 having many of the same features with the same reference numbers, however, the plate 1 of FIG. 8 includes a porous material 5 on the wet side of the plate 1. The porous material 5 can be hydrophilic and can distribute the liquid that passes through the secondary channels. Distributing the liquid passing through the secondary channels can facilitate evaporation and, thereby, cooling of the primary air flow passing through the primary air flow channels. As illustrated in the example of FIG. 8, the gaskets 2 include a slit 11 between the gasket and the plate. The slit 11 receives the edges of the porous material 5 thereby holding the porous material 5 in place on the plate 1. FIG. 9 is another illustration of a plate similar to the plate of FIG. 8 wherein porous material is secured to the wet side of the plate in slits in the gaskets. Otherwise, the description of the numbered features of FIGS. 1, 2, and 3 applies to the same numbered features in FIGS. 8 and 9.

Figure 10:
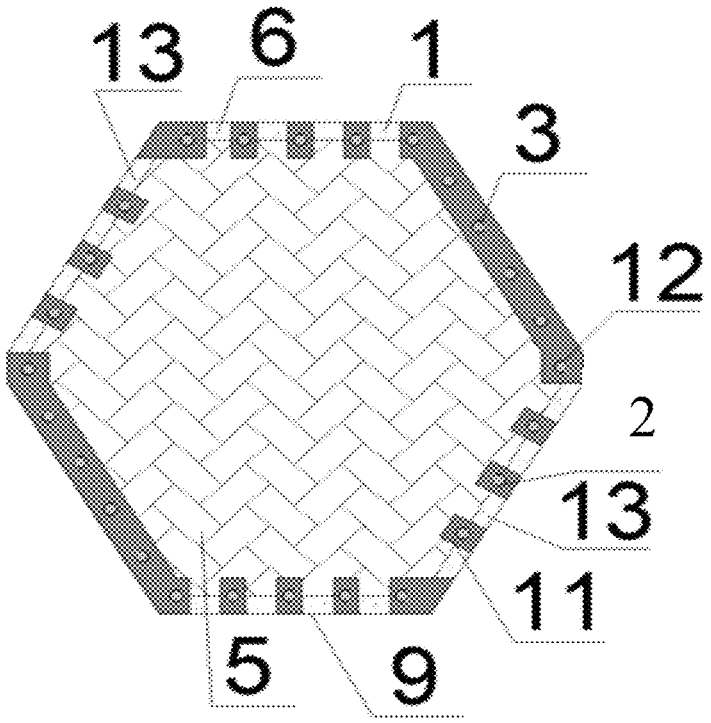
FIG. 10 illustrates a wet side of a hexagonal plate with porous material for an evaporative heat exchanger in accordance with an example embodiment of the disclosure.

FIG. 10 is another example of a plate 1 with porous material 5 similar to the plates of FIGS. 8 and 9, except that the plate 1 in FIG. 10 has a hexagonal shape. Otherwise, the description of the numbered features of FIGS. 1, 2, 3, 8 and 9 applies to the same numbered features in FIG. 10.

Figure 11:
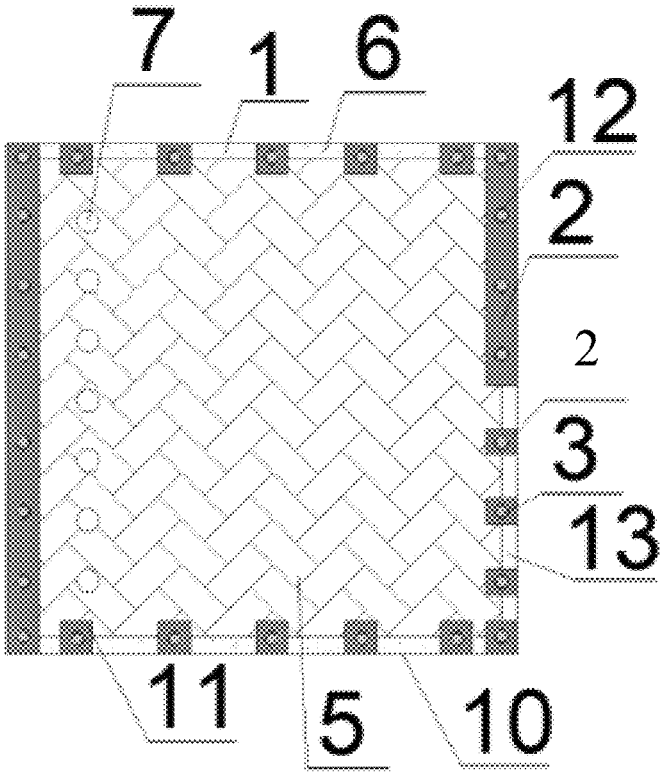
FIG. 11 illustrates a wet side of a rectangular plate with perforations and a porous material for a regenerative evaporative heat exchanger in accordance with an example embodiment of the disclosure.

FIG. 11 is another example of a plate with porous material 5 similar to the plates of FIGS. 8 and 9. However, the plate of FIG. 11 also includes perforations 7 through the plate and through the porous material similar to the perforations previously described in connection with FIGS. 6 and 7. The perforations 7 in the plate of FIG. 11 allow regenerative air flow between the wet side and dry side of the plate 1. Otherwise, the description of the numbered features of FIGS. 1, 2, 3, 8 and 9 applies to the same numbered features in FIG. 11.

Figure 12:
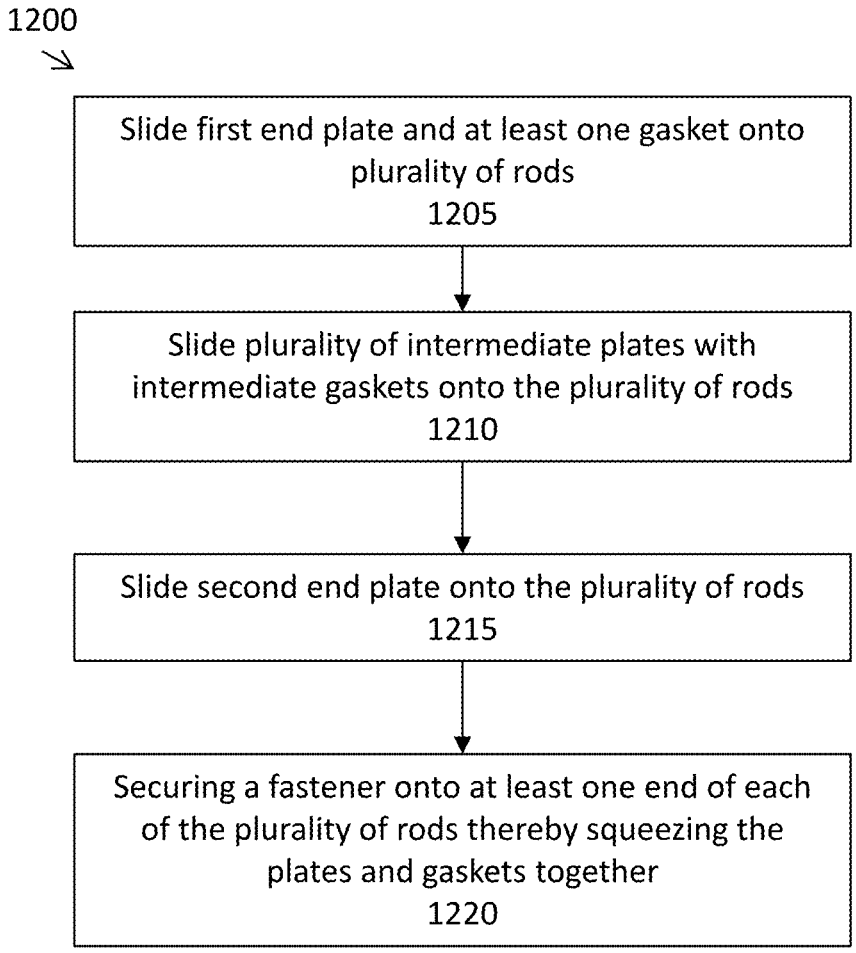
FIG. 12 illustrates a method of assembling the plates of an evaporative heat exchanger in accordance with an example embodiment of the disclosure.

FIG. 12 illustrates an example method for assembling an evaporative heat exchanger in accordance with an example embodiment. The method illustrated in FIG. 12 is a non-limiting example and in alternate embodiments an evaporative heat exchanger can be assembled using other methods or using operations that are performed in a different sequence than described in the example.

The example method of FIG. 12 begins with first operation 1205 in which a first end plate and at least one gasket slide onto a plurality of rods. The at least one gasket slides onto the rods so that it is adjacent to the first end plate. The first end plate is pushed against a fastener at the base of the rods. The base of the rods can include a fixed fastener such as a welded stopper, flange, or pin. Alternatively, the base of the rods can have a removable fastener. The first end plate can have plate apertures through which the rods pass with one rod passing through each plate aperture. Similarly, the at least one gasket can include gasket apertures through which the rods pass with one rod passing through each gasket aperture.

In operation 1210, a plurality of intermediate plates and a plurality of intermediate gaskets slide onto the rods in an alternating manner. As with the first end plate, the intermediate plates have plate apertures through which the rods pass. As with the gasket adjacent to the first end plate, the intermediate gaskets have gasket apertures through which the rods pass.

In operation 1215, a second end plate slides onto the rods so that it is adjacent to the last intermediate gasket that was placed onto the rods. A complete set of plates and gaskets for an evaporative heat exchanger have now been placed on the rods.

In operation 1220, a fastener is secured to each rod at the ends opposite the base of the rods. The fastener can be secured by any of a variety of methods, including threads, pins, and detents. When threaded fasteners are used, they can be tightened onto the rods thereby squeezing the plates and gaskets together to achieve a seal in the primary air flow channels and the secondary air flow channels.

Method 1200 is an example for assembling an evaporative heat exchanger in accordance with the embodiments of this disclosure. Once assembled, the evaporative heat exchanger can be used in an air conditioning system.

Referring to FIG. 13, an example of an air conditioning system 200 comprising an evaporative heat exchanger is illustrated. Consistent with the embodiments disclosed herein, the evaporative heat exchanger of air conditioning system 200 comprises a plurality of parallel plates 201 that have been joined together using rods 203 with fasteners at each end of the rods. The parallel plates form channels therebetween. The channels include primary air flow channels through which the primary air flow passes and secondary air flow channels through which the secondary air flow passes. While not required, as illustrated in FIG. 13, the primary air flow and the secondary air flow can have orientations that are perpendicular to each other. For simplification, gaskets 202 are illustrated in only the secondary air flow channel on the left-most side, but it should be understood that gaskets are present in all of the channels consistent with the descriptions of the preceding Figures. The openings between the gaskets in each channel provide air passages in the primary air flow channels and air and water passages in the secondary air flow channels.

The air conditioning system 200 also includes a water source that supplies water to the secondary air flow channels. As the water flows through the secondary air flow channels, it is evaporated by the secondary air flow, thereby removing heat from the primary air flow. The secondary air flow exits the evaporative heat exchanger in an exhaust air flow. The cooled air of the primary air flow exits the evaporative heat exchanger and is directed by the fan to cool a volume of space. A water reservoir located below the evaporative heat exchanger can collect water that passes through the secondary air flow channels without evaporating. As one option, the water reservoir can return the collected water to the water source. While water is illustrated as the evaporating fluid in air conditioning system 200, it should be understood that other aqueous mixtures or other fluids can be used as the evaporating fluid.

Example Embodiments [EE]

The following are illustrative example embodiments. Other example embodiments beyond those listed below also are within the scope of the disclosure.

[EE1] An evaporative heat exchanger comprising:

a plurality of plates, each plate having opposing broad sides bounded by a plurality of edges and a plurality of plate apertures along the plurality of edges, wherein the plurality of plates are arranged with the opposing broad sides of each plate parallel to the opposing broad sides of the other plates;

a plurality of channels disposed between the plurality of plates, the plurality of channels comprising primary air flow channels and secondary air flow channels, wherein the secondary air flow channels are arranged to receive a liquid;

a plurality of rods joining the plurality of plates, the plurality of rods passing perpendicularly through the plurality of plate apertures in the opposing broad sides of the plurality of plates, wherein each end of the plurality of rods comprises a fastener; and at least one gasket located in each channel of the plurality of channels, the at least one gasket disposed along at least one of the edges of each of the plurality of plates, the at least one gasket in each channel comprising at least one gasket aperture, wherein each of the at least one gasket apertures in the gasket in each channel has disposed therethrough a rod of the plurality of rods.

[EE2] The evaporative heat exchanger of EE1, wherein at least certain plates of the plurality of plates have perforations allowing air to pass between a primary air flow channel and a secondary air flow channel.

[EE3] The evaporative heat exchanger of EE1, wherein at least one of the secondary air flow channels comprises a porous material that absorbs the liquid.

[EE4] The evaporative heat exchanger of EE3, wherein a perimeter of the porous material is disposed within one or more slits in the gasket of the at least one of the secondary air flow channels.

[EE5] The evaporative heat exchanger of EE3, wherein the plates of the at least one of the secondary air flow channels comprising porous material include perforations allowing air to pass between a primary air flow channel and a second air flow channel.

[EE6] The evaporative heat exchanger of EE1, wherein the plurality of plates are rectangular in shape.

[EE7] The evaporative heat exchanger of EE1, wherein the plurality of plates are hexagonal in shape.

[EE8] The evaporative heat exchanger of EE1, wherein the evaporative heat exchanger is disposed in an air conditioning system.

[EE9] A method of assembling an evaporative heat exchanger, the method comprising:

sliding a first end plate at least one end gasket onto a plurality of rods, the first end plate having opposing broad sides bounded by a plurality of edges and a plurality of plate apertures along the plurality of edges, the at least one end gasket having at least one gasket aperture, wherein each of the plurality of plate apertures receives one of the plurality of rods, and wherein the at least one end gasket receives one of the plurality of rods;

sliding a plurality of intermediate plates and intermediate gaskets onto the plurality of rods, each of the plurality of intermediate plates having opposing broad sides bounded by a plurality of edges and a plurality of plate apertures along the plurality of edges, each of the intermediate gaskets having at least one gasket aperture, wherein each of the plurality of plate apertures receives one of the plurality of rods, and wherein the at least one gasket apertures of the intermediate gaskets receive one of the plurality of rods;

sliding a second end plate onto the plurality of rods, the second end plate having opposing broad sides bounded by a plurality of edges and a plurality of plate apertures along the plurality of edges, wherein each of the plurality of plate apertures receives one of the plurality of rods; and securing a fastener onto at least one end of each of the plurality of rods, wherein, once placed on the plurality of rods, the opposing broad sides of the first end plate, the intermediate plates, and the second end plate are parallel.

[EE10] The method of EE9, wherein at least certain plates of the intermediate plates have perforations allowing air to pass between a primary air flow channel and a secondary air flow channel.

[EE11] The method of EE9, wherein at least one air flow channel between the intermediate plates comprises a porous material that absorbs the liquid.

[EE12] The method of EE11, wherein a perimeter of the porous material is disposed within one or more slits in an intermediate gasket of the air flow channel.

[EE13] The method of EE11, wherein the intermediate plates enclosing the at least one air flow channel comprising porous material include perforations allowing air to pass between the air flow channel and a second air flow channel.

[EE14] The method of EE9, wherein the first end plate, the second end plate, and the intermediate plates are rectangular in shape.

[EE15] The method of EE9, wherein the first end plate, the second end plate, and the intermediate plates are hexagonal in shape.

[EE16] The method of EE9, wherein the evaporative heat exchanger is placed within an air conditioning system.

[EE17] An air conditioning system comprising:

at least one fan;

a liquid supply;

a liquid reservoir; and an evaporative heat exchanger, the evaporative heat exchanger comprising:

a plurality of plates, each plate having opposing broad sides bounded by a plurality of edges and a plurality of plate apertures along the plurality of edges, wherein the plurality of plates are arranged with the opposing broad sides of each plate parallel to the opposing broad sides of the other plates;

a plurality of channels disposed between the plurality of plates, the plurality of channels comprising primary air flow channels and secondary air flow channels, wherein the secondary air flow channels are arranged to receive a liquid from the liquid supply;

a plurality of rods joining the plurality of plates, the plurality of rods passing perpendicularly through the plurality of plate apertures in the opposing broad sides of the plurality of plates, wherein each end of the plurality of rods comprises a fastener; and at least one gasket located in each channel of the plurality of channels, the at least one gasket disposed along at least one of the edges of each of the plurality of plates, the at least one gasket in each channel comprising at least one gasket aperture, wherein each of the at least one gasket apertures in the gasket in each channel has disposed therethrough a rod of the plurality of rods.

[EE18] The air conditioning system of EE17, wherein the secondary air flow channels allow evaporation of the liquid thereby cooling a primary air flow through the primary air flow channels; and wherein the fan directs the primary air flow from the air conditioning system.

[EE19] The air conditioning system of EE17, wherein the fastener at one end of each of the plurality of rods is adjustable to allow the plurality of plates and the gaskets to slide onto the plurality of rods and to be secured thereon by the adjustable fasteners of the plurality of rods.

[EE20] The air conditioning system of EE17, wherein the liquid reservoir receives remaining liquid that has not evaporated after the liquid passes through the secondary air flow channels.

For any figure shown and described herein, one or more of the components may be omitted, added, repeated, and/or substituted. Additionally, it should be understood that in certain cases components of the example systems can be combined or can be separated into subcomponents. Accordingly, embodiments shown in a particular figure should not be considered limited to the specific arrangements of components shown in such figure. Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure.

With respect to the example methods described herein, it should be understood that in alternate embodiments, certain steps of the methods may be performed in a different order, may be performed in parallel, or may be omitted. Moreover, in alternate embodiments additional steps may be added to the example methods described herein. Accordingly, the example methods provided herein should be viewed as illustrative and not limiting of the disclosure.

Terms such as "first", "second", "top", "bottom", "side", "distal", "proximal", and "within" are used merely to distinguish one component (or part of a component or state of a component) from another. Such terms are not meant to denote a preference or a particular orientation, and are not meant to limit the embodiments described herein unless specifically indicated by the context. In the example embodiments described herein, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The terms "a," "an," and "the" are intended to include plural alternatives, e.g., at least one. The terms "including", "with", and "having", as used herein, are defined as comprising (i.e., open language), unless specified otherwise.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An evaporative heat exchanger comprising:

a plurality of plates, each plate having opposing broad sides bounded by a plurality of edges and a plurality of plate apertures along the plurality of edges, wherein the plurality of plates are arranged with the opposing broad sides of each plate parallel to the opposing broad sides of the other plates;

a plurality of channels disposed between the plurality of plates, the plurality of channels comprising primary air flow channels and secondary air flow channels, wherein the secondary air flow channels are arranged to receive a liquid;

a plurality of rods joining the plurality of plates, the plurality of rods passing perpendicularly through the plurality of plate apertures in the opposing broad sides of the plurality of plates, wherein each end of the plurality of rods comprises a fastener; and at least one gasket located in each channel of the plurality of channels, the at least one gasket disposed along at least one of the edges of each of the plurality of plates, the at least one gasket in each channel comprising at least one gasket aperture, wherein each of the at least one gasket apertures in the gasket in each channel has disposed therethrough a rod of the plurality of rods.

2. The evaporative heat exchanger of claim 1, wherein at least certain plates of the plurality of plates have perforations allowing air to pass between a primary air flow channel and a secondary air flow channel.

3. The evaporative heat exchanger of claim 1, wherein at least one of the secondary air flow channels comprises a porous material that absorbs the liquid.

4. The evaporative heat exchanger of claim 3, wherein a perimeter of the porous material is disposed within one or more slits in the gasket of the at least one of the secondary air flow channels.

5. The evaporative heat exchanger of claim 3, wherein the plates of the at least one of the secondary air flow channels comprising porous material include perforations allowing air to pass between a primary air flow channel and a second air flow channel.

6. The evaporative heat exchanger of claim 1, wherein the plurality of plates are rectangular in shape.

7. The evaporative heat exchanger of claim 1, wherein the plurality of plates are hexagonal in shape.

8. The evaporative heat exchanger of claim 1, wherein the evaporative heat exchanger is disposed in an air conditioning system.

9. A method of assembling an evaporative heat exchanger, the method comprising:

sliding a first end plate at least one end gasket onto a plurality of rods, the first end plate having opposing broad sides bounded by a plurality of edges and a plurality of plate apertures along the plurality of edges, the at least one end gasket having at least one gasket aperture, wherein each of the plurality of plate apertures receives one of the plurality of rods, and wherein the at least one end gasket receives one of the plurality of rods;

sliding a plurality of intermediate plates and intermediate gaskets onto the plurality of rods, each of the plurality of intermediate plates having opposing broad sides bounded by a plurality of edges and a plurality of plate apertures along the plurality of edges, each of the intermediate gaskets having at least one gasket aperture, wherein each of the plurality of plate apertures receives one of the plurality of rods, and wherein the at least one gasket apertures of the intermediate gaskets receive one of the plurality of rods;

sliding a second end plate onto the plurality of rods, the second end plate having opposing broad sides bounded by a plurality of edges and a plurality of plate apertures along the plurality of edges, wherein each of the plurality of plate apertures receives one of the plurality of rods; and securing a fastener onto at least one end of each of the plurality of rods, wherein, once placed on the plurality of rods, the opposing broad sides of the first end plate, the intermediate plates, and the second end plate are parallel.

10. The method of claim 9, wherein at least certain plates of the intermediate plates have perforations allowing air to pass between a primary air flow channel and a secondary air flow channel.

11. The method of claim 9, wherein at least one air flow channel between the intermediate plates comprises a porous material that absorbs the liquid.

12. The method of claim 11, wherein a perimeter of the porous material is disposed within one or more slits in an intermediate gasket of the air flow channel.

13. The method of claim 11, wherein the intermediate plates enclosing the at least one air flow channel comprising porous material include perforations allowing air to pass between the air flow channel and a second air flow channel.

14. The method of claim 9, wherein the first end plate, the second end plate, and the intermediate plates are rectangular in shape.

15. The method of claim 9, wherein the first end plate, the second end plate, and the intermediate plates are hexagonal in shape.

16. The method of claim 9, wherein the evaporative heat exchanger is placed within an air conditioning system.

17. An air conditioning system comprising:

at least one fan;

a liquid supply;

a liquid reservoir; and an evaporative heat exchanger, the evaporative heat exchanger comprising:

a plurality of plates, each plate having opposing broad sides bounded by a plurality of edges and a plurality of plate apertures along the plurality of edges, wherein the plurality of plates are arranged with the opposing broad sides of each plate parallel to the opposing broad sides of the other plates;

a plurality of channels disposed between the plurality of plates, the plurality of channels comprising primary air flow channels and secondary air flow channels, wherein the secondary air flow channels are arranged to receive a liquid from the liquid supply;

a plurality of rods joining the plurality of plates, the plurality of rods passing perpendicularly through the plurality of plate apertures in the opposing broad sides of the plurality of plates, wherein each end of the plurality of rods comprises a fastener; and at least one gasket located in each channel of the plurality of channels, the at least one gasket disposed along at least one of the edges of each of the plurality of plates, the at least one gasket in each channel comprising at least one gasket aperture, wherein each of the at least one gasket apertures in the gasket in each channel has disposed therethrough a rod of the plurality of rods.

18. The air conditioning system of claim 17, wherein the secondary air flow channels allow evaporation of the liquid thereby cooling a primary air flow through the primary air flow channels; and wherein the fan directs the primary air flow from the air conditioning system.

19. The air conditioning system of claim 17, wherein the fastener at one end of each of the plurality of rods is adjustable to allow the plurality of plates and the gaskets to slide onto the plurality of rods and to be secured thereon by the adjustable fasteners of the plurality of rods.

20. The air conditioning system of claim 17, wherein the liquid reservoir receives remaining liquid that has not evaporated after the liquid passes through the secondary air flow channels.

* * * * *